US011578953B2

(12) United States Patent
McGregor et al.

(10) Patent No.: US 11,578,953 B2
(45) Date of Patent: Feb. 14, 2023

(54) PERFORATION TOOL AND LABORATORY TESTING SYSTEM WITH AN ADJUSTABLE FREE INTERIOR VOLUME

(71) Applicant: Halliburton Energy Services, Inc., Houston, TX (US)

(72) Inventors: Jacob Andrew McGregor, Ft. Worth, TX (US); John Norris Smith, Burleson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 305 days.

(21) Appl. No.: 16/871,963

(22) Filed: May 11, 2020

(65) Prior Publication Data

US 2021/0348891 A1 Nov. 11, 2021

(51) Int. Cl.

| | |
|---|---|
| ***F42B 1/028*** | (2006.01) |
| ***E21B 43/116*** | (2006.01) |
| ***F42B 35/00*** | (2006.01) |
| *F42D 1/05* | (2006.01) |

(52) U.S. Cl.

CPC ..... *F42B 1/028* (2013.01); *F42B 35/00* (2013.01); *E21B 43/116* (2013.01); *F42D 1/05* (2013.01)

(58) Field of Classification Search

CPC ..... F42B 3/00; F42B 3/08; F42B 3/24; F42B 3/28

See application file for complete search history.

(56) References Cited

U.S. PATENT DOCUMENTS

| | | | | |
|---|---|---|---|---|
| 3,143,068 | A * | 8/1964 | Bell | E21B 43/117 102/310 |
| 3,224,368 | A * | 12/1965 | Alfredm | F42B 1/032 102/306 |
| 3,288,958 | A * | 11/1966 | Walther | H01R 13/533 200/51.09 |
| 5,915,694 | A * | 6/1999 | Brum | H01Q 15/145 273/362 |
| 8,127,654 | B2 | 3/2012 | Williams et al. | |
| 8,794,326 | B2 | 8/2014 | Le et al. | |

(Continued)

FOREIGN PATENT DOCUMENTS

CN 209277861 U * 8/2019

*Primary Examiner* — Gabriel J. Klein

(74) *Attorney, Agent, or Firm* — John Wustenberg; Parker Justiss, P.C.

(57) ABSTRACT

A perforating tool including a body, a first lid and a second lid, the first lid attachable to one end of the body and the second lid attachable to an opposite end of the body, to define an interior cavity of the body. The interior cavity has an air-tight seal with an exterior environment surrounding the body. In some aspects, one or more plates are disposable within the interior cavity such that the one or more plates are situated apart from an explosive charge when the explosive charge is disposed in the interior cavity, the one or more plates occupying part of a total interior volume of the interior cavity and thereby reducing a free interior volume inside the body. In some aspects, two or more plates are disposable within the interior cavity such that the two or more plates are situated apart from an explosive charge when the explosive charge is disposed in the interior cavity, the two or more plates occupying part of a total interior volume of the interior cavity and thereby reducing a free interior volume inside the body.

17 Claims, 5 Drawing Sheets

(56) References Cited

U.S. PATENT DOCUMENTS

| | | | | |
|---|---|---|---|---|
| 10,060,234 | B2 | 8/2018 | Robey et al. | |
| 10,683,735 | B1 * | 6/2020 | McCarthy | F42B 1/028 |
| 2014/0122035 | A1 * | 5/2014 | Dean | E21B 43/00 703/2 |
| 2014/0262503 | A1 | 9/2014 | Rodgers et al. | |
| 2018/0298732 | A1 * | 10/2018 | Haggerty | E21B 41/0092 |
| 2020/0088013 | A1 | 3/2020 | Grove et al. | |
| 2021/0131931 | A1 * | 5/2021 | Haggerty | G01N 33/24 |

* cited by examiner

PERFORATION TOOL AND LABORATORY TESTING SYSTEM WITH AN ADJUSTABLE FREE INTERIOR VOLUME

BACKGROUND

A perforating tool is commonly used to maximize the potential recovery of hydrocarbons, such as oil and gas obtained from subterranean formations that may be located onshore or offshore. However, for a given recovery operation, the perforating tool may be selected based on limited knowledge of the likely downhole explosive charge performance A selection of in-field perforating tool parameters may be based in part on tests performed using laboratory tools designed to evaluate explosive charge performance, e.g., by measuring depth of penetration.

BRIEF DESCRIPTION

Figure 1A:
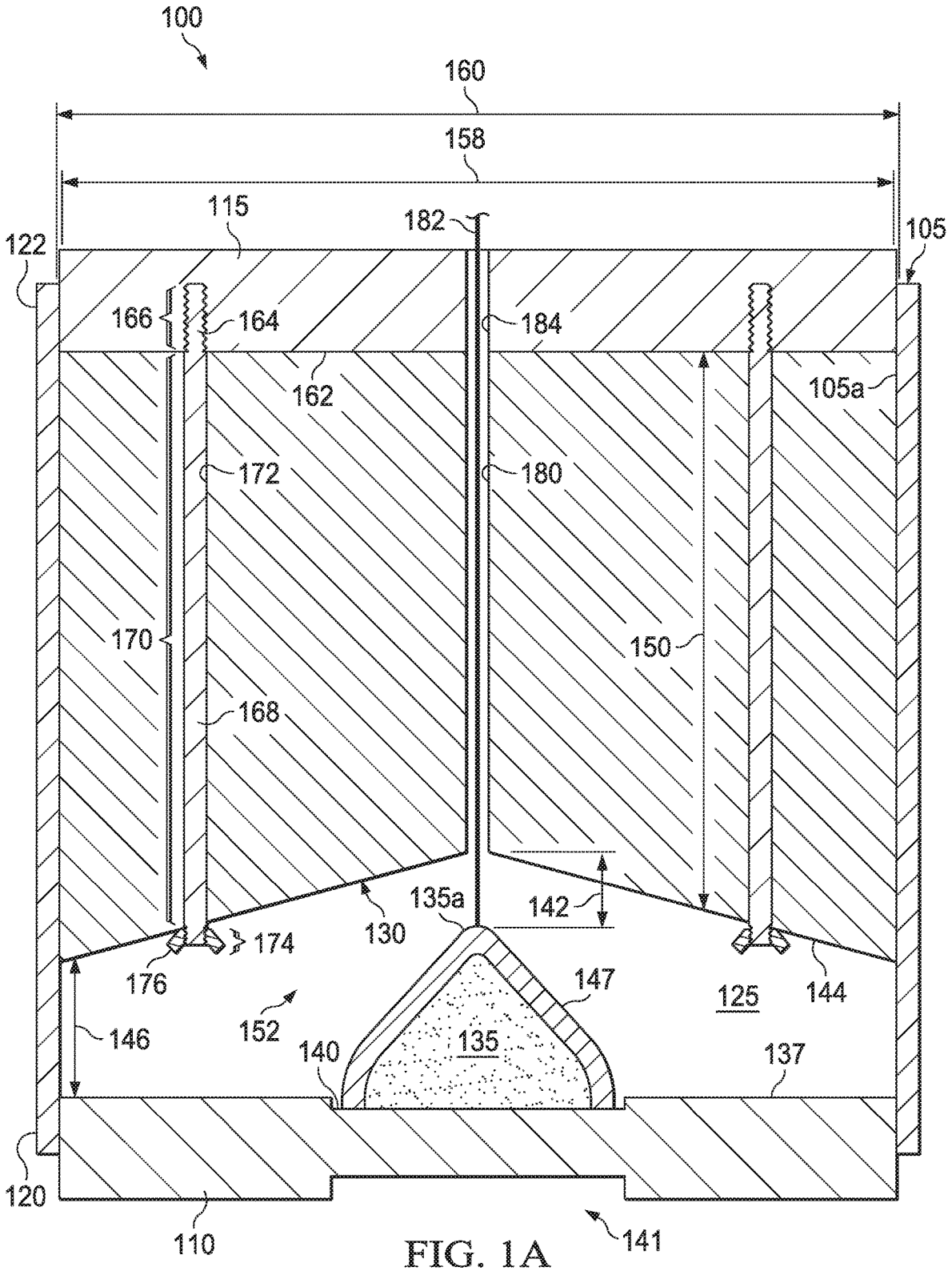
Figure 1B:
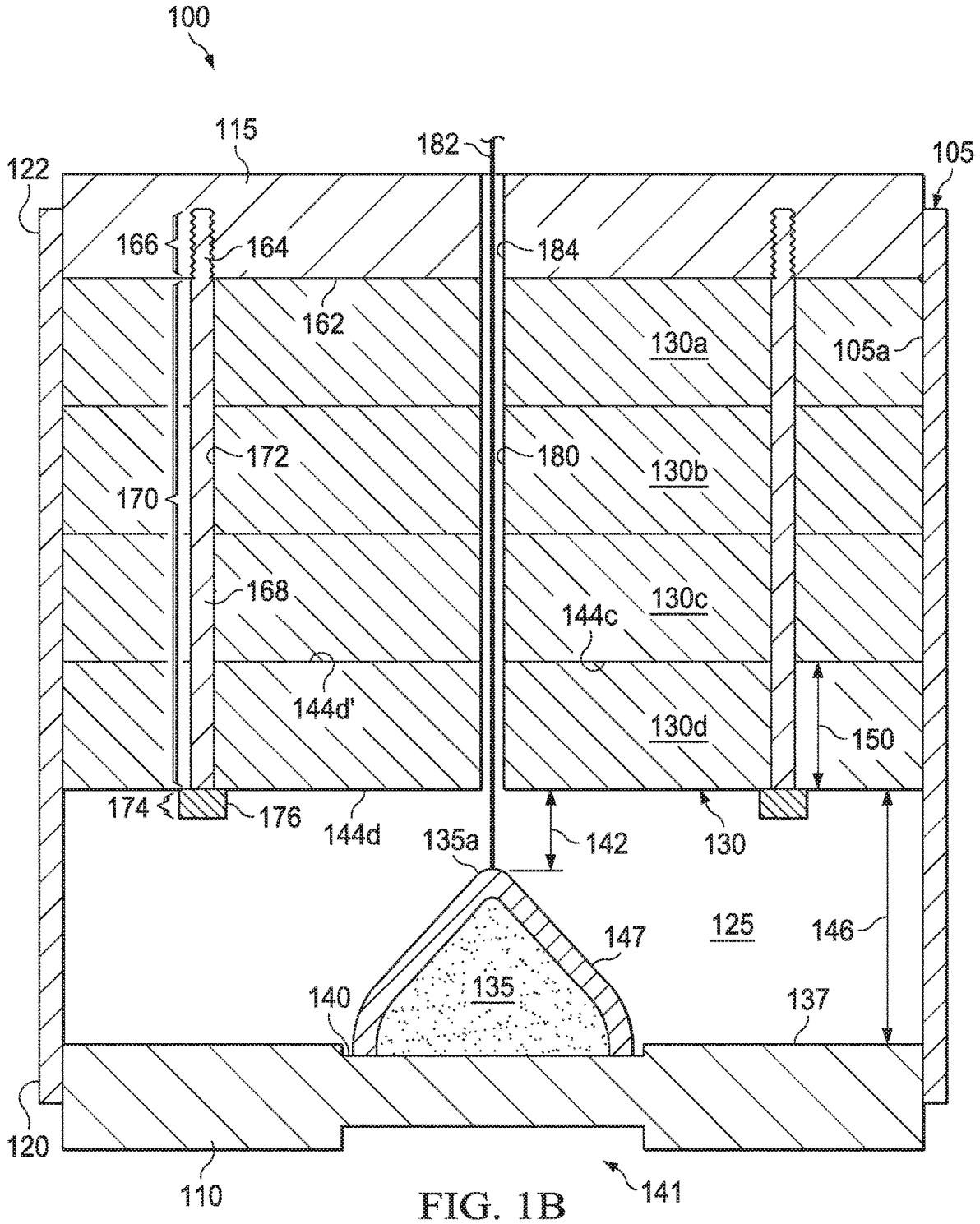
Figure 1C:
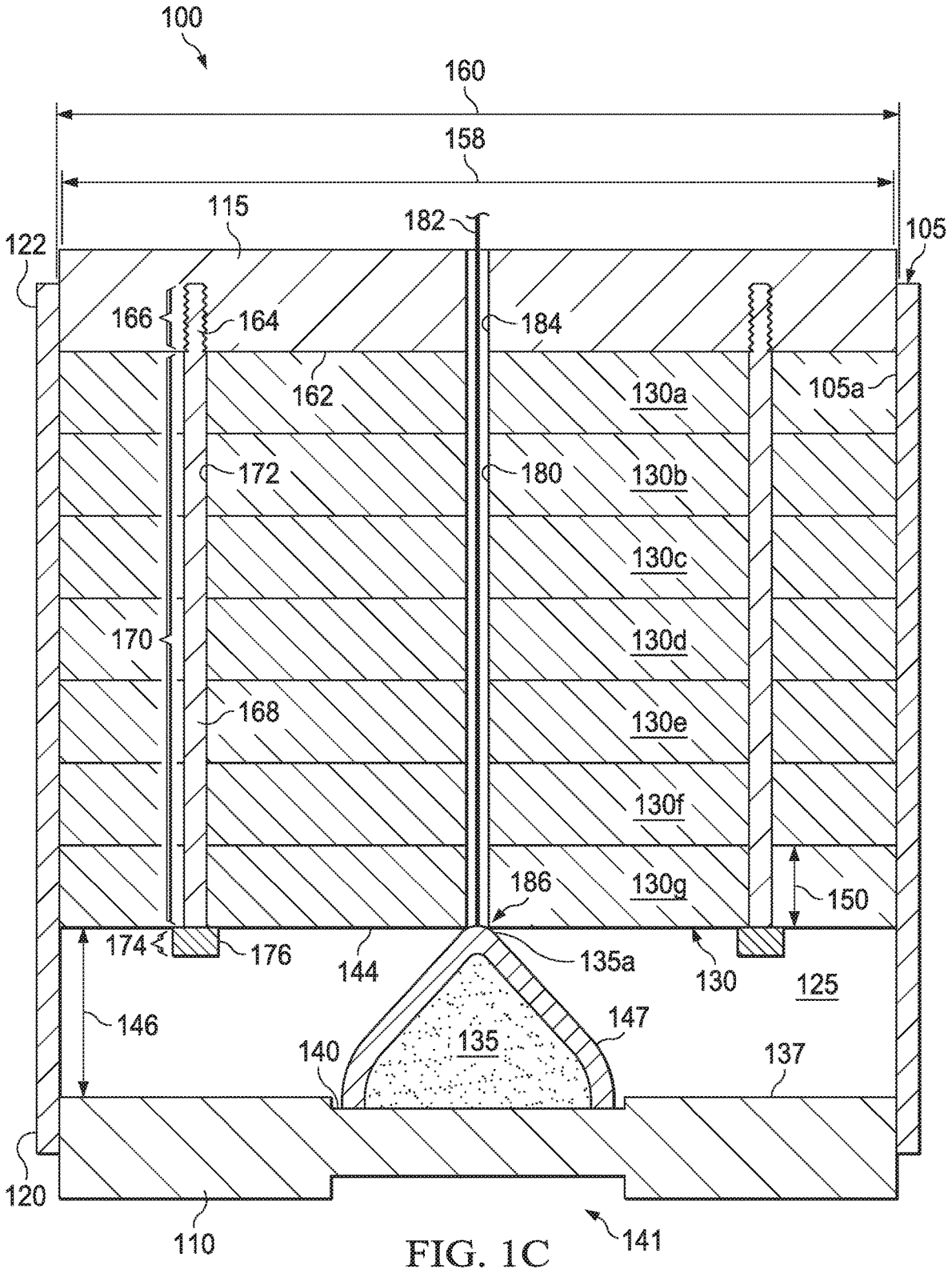
Figure 1D:
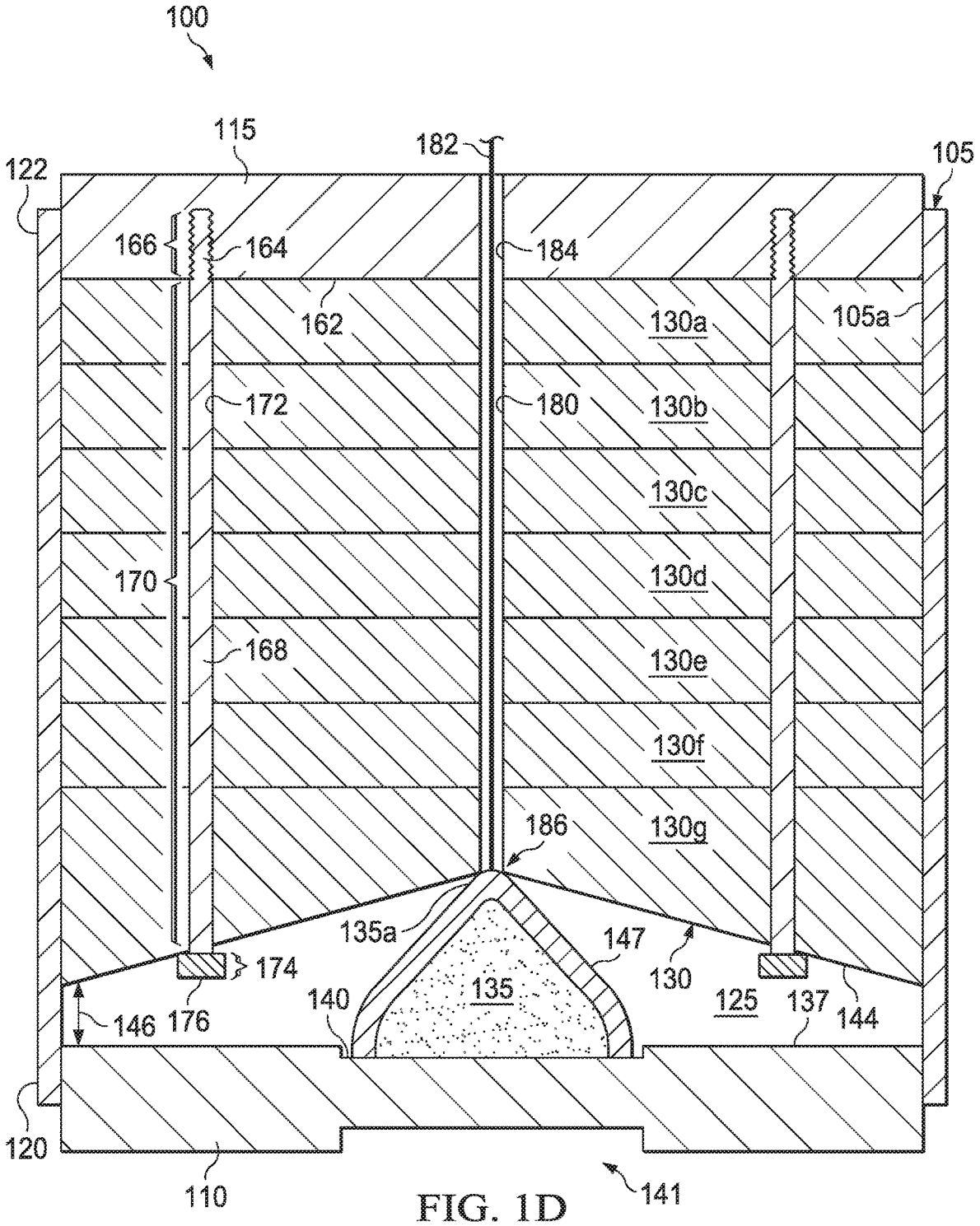
Figure 2:
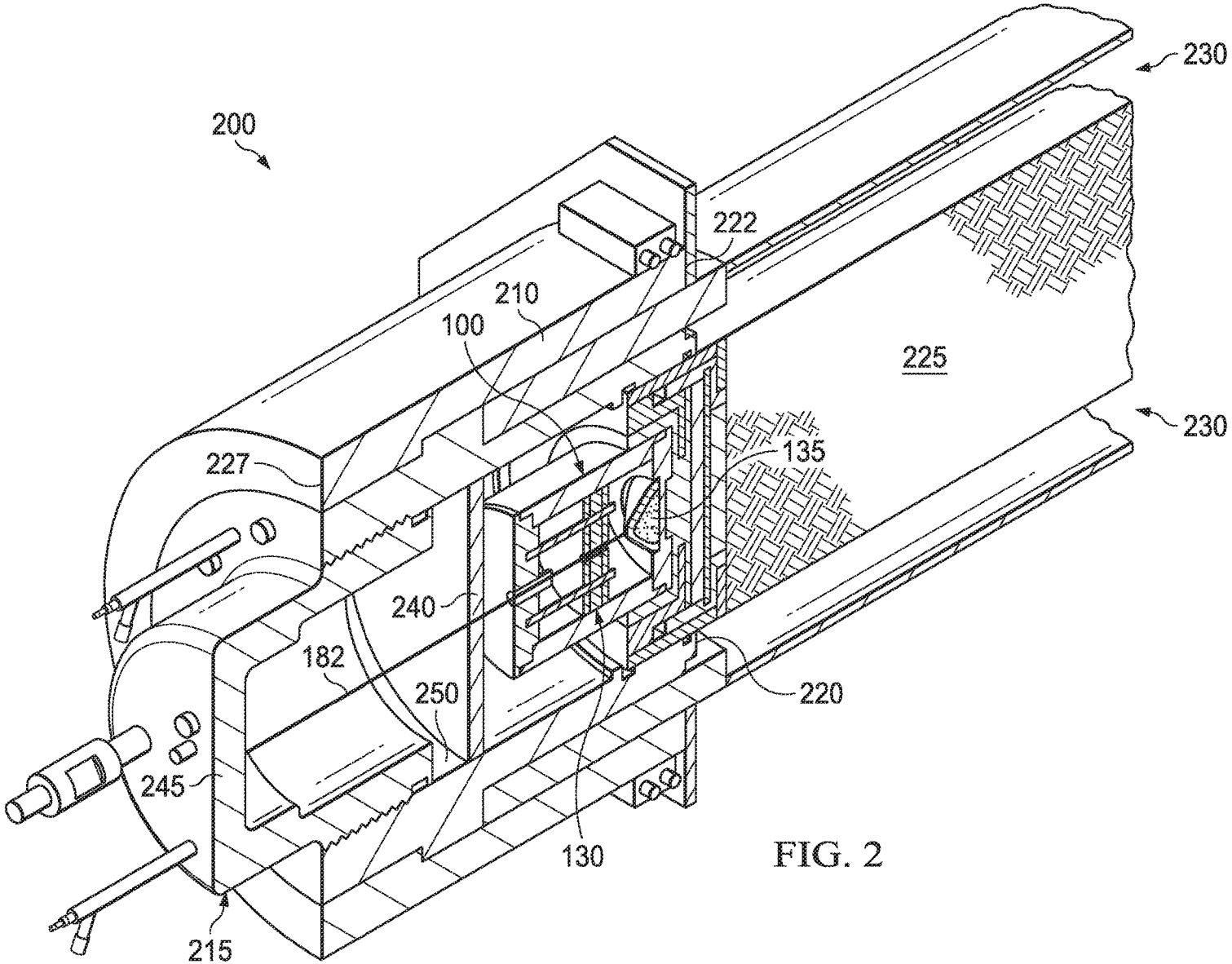

Reference is now made to the following descriptions taken in conjunction with the accompanying drawings, in which:

FIG. 1A presents a cross-sectional view of an example embodiment of a perforating tool having one or more plates disposed within an interior cavity in accordance with the present disclosure;

FIG. 1B presents a cross-sectional view of another example embodiment of the perforating tool having one or more plates disposed within an interior cavity in accordance with the present disclosure;

FIG. 1C presents a cross-sectional view of an additional example embodiment of the perforating tool having two or more plates disposed within an interior cavity in accordance with the present disclosure;

FIG. 1D presents a cross-sectional view of an additional example embodiment of the perforating tool having two or more plates disposed within an interior cavity in accordance with the present disclosure; and FIG. 2 presents a perspective view of an example embodiment of a perforating tool testing system which can include any of the embodiments of the perforating tool, such as presented in the context of FIGS. 1A-1D, in accordance with the present disclosure.

DETAILED DESCRIPTION

Disclosed herein are embodiments of a perforating tool where the free interior volume inside the tool body (also often referred herein to as free gun volume, FGV) can be readily adjusted by disposing various numbers of plates inside an interior cavity of the tool body. Adjustment of the free interior volume in turn changes the nature of the pressure response when an explosive charge inside the tool body is detonated, e.g., when used in a perforating tool testing system. In particular, the perforating tool facilitates creating a desired dynamic underbalance (DUB) or dynamic overbalance (DOB) pressure response when testing and simulating in-field perforating tool parameters.

The term DUB refers to a transient pressure condition in which the wellbore pressure during a perforating operation is less than the adjacent formation pore pressure. The term DOB refers to a transient pressure condition in which the wellbore pressure during a perforating operation is greater than the adjacent formation pore pressure.

Embodiments of the perforating tool disclosed herein are advantageous over other ways to adjust free interior volume. The plates of the tool can reduce the free interior volume to a greater degree than packing the interior cavity of the tool body with loose particles (e.g., ball bearings and/or sand), due the latter's inherent porosity. The plates can be readily put into the interior cavity of the tool body such that they are situated apart from the explosive charge, to more realistically simulate a field perforating tool which, e.g., typically does not include loose particles packed against the explosive charge. The plates can be readily taken out of the interior cavity of the tool body if it is decided at the last minute that a different FGV adjustment is desired. The ability to readily and reproducibly adjust the free interior volume by disposing a selected number of the plates inside the interior cavity of the tool body is also cost and time advantageous over having to machine a new tool body every time a specific new free interior volume is desired to be tested.

One embodiment of the disclosure is a perforating tool. FIGS. 1A and 1B present cross-sectional views of example embodiments of a perforating tool having one or more plates disposed within the interior cavity.

With continuing reference to FIGS. 1A and 1B throughout, the perforating tool 100 includes a body 105 (also known as a gun body), a first (e.g., bottom lid) lid 110 and a second (e.g., top lid) lid 115. The first lid 110 is attachable to one end of the body 105 (e.g., bottom end 120) and the second lid 115 is attachable to an opposite end (e.g., top end 122) of the body 105, to define an interior cavity of the body 105, the interior cavity 125 having an air-tight seal with an exterior environment surrounding the body 105. The perforating tool 100 includes one or more plates (e.g., FIG. 1A one plate 130; FIG. 1B multiple plates 130*a*, 130*b*, 130*c*, 130*d*) disposable within the interior cavity such that the one or more plates are situated apart from the explosive charge, the one or more plates occupying part of a total interior volume of the interior cavity 125 and thereby reducing a free interior volume inside the body.

The perforating tool 100 includes one or more plates (e.g., FIG. 1A one plate 130; FIG. 1B multiple plates 130*a*, 130*b*, 130*c*, 130*d*) disposable within the interior cavity such that the plates are situated apart from an explosive charge (e.g., explosive charge 135, including any housing holding the explosive charge) when the explosive charge is disposed in the interior cavity, the one or more plates occupying part of a total interior volume of the interior cavity 125 and thereby reduces a free interior volume inside the body.

Embodiments of the first lid 110 can includes an explosive charge depot 140 within the interior cavity to provide a location where the explosive charge can be disposed. For instance, the explosive charge depot 140 can be an indentation in the interior surface 137 of the first lid 110 or other mounting location on the surface 137. Embodiments of the first lid 110 can include a recess 141 to enhance operation of perforating tool 100. In some embodiments, the explosive charge depot 140 and the recess 141 can be aligned with each other.

The term air-tight seal refers to sealing elements between the first and second lids 110, 115 and the body 105, and the function they serve, e.g., when the lids are attached to the body, the entrapped fluid within the body (e.g., air) is no longer in hydraulic communication with fluid in the exterior environment surrounding the body. The term situated apart refers to a surface of the nearest plate 130 being a non-zero distance away from the explosive charge such that air within the interior cavity can pass between the nearest plate surface and the explosive charge. In some embodiments, a separation distance 142 between the surface of the nearest plate (e.g., surface 144 of one plate 130 in FIG. 1A or surface 144*d* of nearest plate 130*d*) and the explosive charge 135 can be a fraction (e.g., $1/100^{th}$, $1/10^{th}$, $2/10^{th}$ . . . 1 times, 2 times, 3 times) of a maximum height (e.g., explosive charge height 145) of the explosive charge 135 above the first lid interior surface 137. For instance, in some embodiments, when the height 145 of the explosive charge 135 is about 10 cm, then the separation distance 142 can be about 0.1, 1, 2, . . . 10, 20, or 30 cm.

In some embodiments, to provide a free volume space around the explosive charge 135, the one or more plates 130 are situated apart from the first lid 110. For example, in some embodiments, a separation distance 146 between the surface of the nearest plate (e.g., surface 144 of one plate 130 in FIG. 1A or surface 144*d* of nearest plate 130*d*) and the first lid interior surface 137 can be non-zero value and in some embodiments, a fraction (e.g., $1/100^{th}$, $1/10^{th}$, $2/10^{th}$ . . . 1 times, 2 times, 3 times) of a maximum height (e.g., explosive charge height 145) of the explosive charge 135 above the first lid interior surface 137. In some embodiments, to facilitate directing an explosive shock wave, generated when the explosive charge is detonated, towards the first lid 110, all or a portion of the one of more plates 135 are located distal to the first lid 110 and above a backend of the explosive charge (end 135*a*). For instance the one or more plates 130 do not occupy space in the interior cavity 125 located between an interior surface the body 105 (e.g., surface 105*a*) and a side wall of the explosive charge (e.g., side wall 147).

The term free interior volume (FGV) refers to the void space inside of the body's interior cavity that is not occupied by solid structures, e.g., the explosive charge, the plates or any other structures that would displace air in the interior cavity.

In some embodiments of the tool 100, to at least help provide a large adjustable FGV range, the one or more plates 130, in combination, can be configured to occupy between 0 and 100 percent of the total interior volume of the interior cavity 125. For instance, in some embodiments, the plates can be such that the total interior volume occupied by the one or more plates 130 can be greater than 0 (e.g., 0.1 or 1 percent or more) and less than 100 percent (e.g., 99 or 99.9 percent or less), greater than 10 and less than 90 percent, greater than 20 and less than 80 percent, greater than 30 and less than 70 percent, greater than 40 and less than 60 percent, or a range from 10 to 30 percent, from 30 to 60 percent, from 60 to 90 percent, or any other combination of these ranges.

In some embodiments of the tool 100, to at least help provide precise incremental adjustments to the FGV, individual ones of the plates can be sized such that any one of the plates occupy from greater than 0 to nearly 100 percent of the total interior volume. For example, the plates can be sized by adjusting the individual plate's thickness (e.g., thickness 150 or average thickness for plates with a non-planar surface, such as a surface having a depression). For example, each one plate can occupy a percentage of the total interior volume in a range from about 0.1 or 1 to nearly 100 percent (e.g., 99 or 99.9 percent), from 25 to 50 percent, from 10 to 20 percent, from 5 to 10 percent, or from 1 to 2 percent of the total interior volume. In some embodiments, each one of the plates can be equally sized and occupy a same percentage of the total interior volume e.g., 100 plates each occupying about 1 percent, 10 plates each occupying 10 percent, or 2 plates each occupying 50 percent. In other embodiments, the plates are not equally sized e.g., each plate, or different groups of plates, can be differently sized from each other so as to occupy different percentages of the total interior volume.

In some embodiments of the tool 100, to at least facilitate keeping the adjusted free interior volume constant during explosive charge detonation, the plates can be composed of a non-deformable and impermeable material. For example, the plates can be composed of aluminum, steel, or other metals, or other materials that are non-porous and non-compressible during and after the detonation of the explosive charge. In some embodiments, the plates can be solid plates, while in other embodiments the plates can include hollow portions, e.g., to reduce the material costs and weight of the plates. However, in at least one embodiment, during and following the detonation of the explosive charge, the plates remain intact and do not change shape such that the portion of the total interior volume of the interior cavity occupied by the plates is not changed. For example, expanding gases or solid material accelerated by the detonation do not permeate into the plates or change the volume occupied by the plates.

In some embodiments of the tool 100, to at least to facilitate to keep the plates apart from the explosive charge 135 and further reduce the FGV, a surface of the one plate facing and nearest (e.g., surface 144 of plate 130 in FIG. 1A or surface 144*d* of the one plate 130*d* in FIG. 1B) to the explosive charge 135 can be shaped to form a depression 152 that somewhat mirrors a shape of the explosive charge. For example, when the explosive charge has cone shape, then the surface of the one solid plate nearest the explosive charge can have a corresponding inverse cone-shaped depression that somewhat mirrors the cone shape of the explosive charge. In some such embodiments, the depression can be shaped such that at least a portion of the explosive charge can fit within the depression. In still other embodiments, the surface of the plate nearest the explosive charge is not shaped to mirror a shape of the explosive charge. For example, in some embodiments, such as illustrated in FIG. 1B, none of the plates 130*a* . . . 130*d*, including the one plate 130*d* nearest the explosive charge, may have the depression, e.g., the surface 144*d* can be a planar surface.

In some embodiments of the tool 100, to facilitate reducing the FGV, at least two, and in some embodiments, all, of the one or more plates are shaped to stack together. For example, in some embodiments, a surface 144*d'* of the plate 130*d* facing away from the explosive charge matches a surface 144*c* of an adjacent plate 130*c*. For example, in some embodiments, adjacent surfaces of the plates (e.g., surfaces 144*c* and 144*d'*) are planar surfaces.

In some embodiments of the tool 100, to at least facilitate reducing the FGV and making plates readily insertable into, or removable from, the interior cavity 125, the one or more plates (e.g., the one plate 130, or the plates 130*a*, . . . 130*d*) are shaped to fit flush against an interior wall of the body (e.g., interior body wall 105*a*). For example, when the interior cavity of the body 105 is defined by a cylindrically shaped wall (e.g., wall 105*a*) then the one or more solid plates can have a cylindrical shape to fit flush against the cylindrically shaped wall. For example, in some embodiments, the one or more cylindrically shaped plates can have a diameter 158 that is 0.01, 0.1, 1, 2, 5 or 10 percent or less than an internal diameter 160 of the body 105.

In some embodiments of the tool 100, to secure the plates, a surface of the second lid (e.g., internal surface 162 of the top lid 115) facing the interior cavity 125 includes a port (e.g., port 164 or a plurality of such ports) to secure a first end portion of a rod therein (e.g., first end portion 166 of rod 168). A stem portion (e.g., stem portion 170) of the rod is sized to pass through an opening in each of the one or more plates (e.g., through-hole opening 172) and a second end portion of the rod (e.g., second end portion 174) includes a stop structure sized to not pass through the one or more openings in the plate (e.g., stop structure 176, such as a wing nut or flat head bolt as illustrated in FIGS. 1A and 1B respectively). For example, mounting the one or more plates to the internal surface 162 of the top lid 115 via one or more of such rods 168, can prevent gravity from pulling the plates down to inadvertently touch the explosive charge 135. For example, in some embodiments, the port 164 can be threaded such that a threaded first end portion 166 of rod 168 can be secured therein.

In some embodiments of the tool 100, each of the one or more plates can include an opening (e.g., second opening 180) sized to allow a portion of a detonation cord (e.g., cord 182) there-through to connect to the explosive charge 135. The second lid 115 can include an opening 184 sized to allow a portion of a detonation cord there-through.

FIGS. 1C and 1D present cross-sectional views of additional example embodiments of the perforating tool having two or more plates disposed within the interior cavity in accordance with the present disclosure.

With continuing reference to FIGS. 1C and 1D, the tool 100 includes the body 105, the first lid 110 and the second lid 115, the first lid 110 is attachable to one end of the body 105, the second lid 115 is attachable to the opposite end 122 of the body to define the interior cavity 125 of the body. In these embodiments, the interior cavity 125 has an air-tight seal with an exterior environment surrounding the body 105, and, the explosive charge depot 140 within the interior cavity 125. The tool 100 includes two or more plates 130 disposed within the interior cavity 125 such that the two or more plates 130 are situated apart from an explosive charge 135 when the explosive charge 135 is disposed in the interior cavity 125, where the two or more plates 130 occupy part of a total interior volume of the interior cavity 125 and thereby reduce a free interior volume inside the body 105.

For some embodiments, as illustrated FIGS. 1C and 1D, a surface of one plate of the two or more plates 130 that faces and is nearest to the explosive charge 135 (e.g., surface 144 of plate 130*g*), touches the explosive charge 135. Similar to that already discussed in the context of FIGS. 1A and 1B, in some such embodiments, the surface of the one plate facing and touching the explosive charge 135 can be shaped to form a depression 152 that mirrors a shape of the explosive charge 135 (e.g., depression 152 in surface 144, FIG. 1D), while in other embodiments, the surface of the one plate facing and touching the explosive charge 135 is a planar surface (e.g., surface 144, FIG. 1C).

In other embodiments, as discussed in the context of FIGS. 1A and 1B, the two or more plates disposed within the interior cavity can be situated apart from the explosive charge. Also as discussed in the context of FIGS. 1A and 1B, in some such embodiments, the surface of one plate of the two or more plates that faces and is nearest to the explosive charge can be shaped to form a depression that mirrors a shape of the explosive charge while in other embodiments the surface of the one plate facing and nearest the explosive charge can be a planar surface.

The embodiments of the tool 100 having two or more plates, such as illustrated in FIGS. 1C and 1D, can have any features and example features as discussed in the context of FIGS. 1A and 1B.

For example, the two or more plates in combination can occupy between 0 and 100 percent of the total interior volume of the interior cavity. Individual ones of the two or more plates can be sized such that any one of the plates occupy from at least 1 to nearly 100 percent of the total interior volume. The two or more plates can be composed of a non-deformable and impermeable material. The two or more plates can be shaped to stack together. The two or more plates can be shaped to fit flush against an interior wall of the body. A surface of the second lid facing the interior cavity can include a port to secure a first end portion of a rod therein, where a stem portion of the rod can be sized to pass through an opening in each of the two or more plates and a second end portion of the rod includes a stop structure sized to not pass through the one or more openings in the two or more plates. Each of the two or more solid plates can include an opening sized to allow a portion of a detonation cord there-though.

Similar to that discussed in the context of FIGS. 1A and 1B, the one or more plates 130 of the tool 100 embodiments of FIGS. 1C and 1D can be situated apart from the first lid 110, e.g., by separation distance 146. In some such embodiments, all or a portion of the two of more plates 135 are not in-between an interior wall 105*a* the body 105 and a side wall of the explosive charge (e.g., side wall 147). For instance, the surface 144 of one plate of the two or more plates 130 that faces the explosive charge 135, can touch the explosive charge at a surface of the back end 135*a* of the explosive charge 135 (e.g., at surface 186).

FIG. 2 presents a perspective view of an example embodiment of a perforating tool testing system 200 which can include any of the embodiments of the perforating tool 100, e.g., as a laboratory perforating tool, such as presented in the context of FIGS. 1A-1D, in accordance with the present disclosure.

The perforating tool testing system 200 includes a simulated wellbore case 210. Embodiments of the simulated wellbore case 210 can be cylindrically shaped or any suitable shape that facilitates simulation an in-field wellbore system using a laboratory perforation tool 100 of the disclosure. The system 200 includes a simulated wellbore 215 disposed within the simulated wellbore case 210 and a face plate 220 disposed at a first end 222 of the simulated wellbore. The system 200 includes a formation sample 225 disposed within the simulated wellbore case, wherein the formation sample couples to the face plate. The perforating tool testing system 200 additionally includes the laboratory perforating tool 100 disposed within the simulated wellbore 215 between the first end 222 and a second end 227 of the simulated wellbore.

As disclosed in the context of FIGS. 1A-1D, the laboratory perforating tool 100 includes the body 105, first lid 110 and second lid 115, where the first lid is attachable to one end 120 of the body and the second lid is attachable to an opposite end 122 of the body, to define the interior cavity 125 of the body, the interior cavity having an air-tight seal with an exterior environment surrounding the body (e.g., the environment in the simulated wellbore 215).

In some embodiments, the laboratory perforating tool 100 includes one or more plates 130 disposable within the interior cavity such that the one or more plates are situated apart from an explosive charge 135 when the explosive charge is disposed in the interior cavity, the one or more plates occupying part of a total interior volume of the interior cavity and thereby reducing a free interior volume inside the body.

In other embodiments, the laboratory perforating tool 100 includes two or more plates 130 disposable within the interior cavity such that the two or more plates are situated apart from an explosive charge when the explosive charge is disposed in the interior cavity, the two or more plates occupying part of a total interior volume of the interior cavity and thereby reducing a free interior volume inside the body.

The explosive charge 135 is disposed such that detonation of the explosive charge creates a perforation in the formation sample 225, and the one or more plates affect a dynamic underbalance (DUB) or dynamic overbalance (DOB) of the perforating tool testing system.

The simulated wellbore 215 can be pressurized to apply a pressure, e.g., that approximates a wellbore pressure, to the tool 100. Embodiments of the simulated wellbore 215 can comply with the API RP 19 Section 2 and Section 4 wellbore cavity requirements.

For instance, the system 200 can include one or more fluid chambers 230 disposed about the formation sample 225. The fluid chambers 230 can include fluid used to apply an overburden or an underburden pressure during a simulation to simulate overburden stress or underburden on the formation sample 225.

The perforating tool system 100 can be arranged or include various components as required to facilitate a given testing operation. A detonation cord 182 can be coupled to the explosive charge 135 of the tool 100. The detonation cord 182 can pass through an opening (e.g., opening 184 of second lid 115, FIGS. 1A-1D) at one end of the perforating tool 100 (e.g., lid 115) or any other location of the tool 100. The detonation cord 182 can be directly or indirectly coupled to or electrically or communicatively coupled to a power source or information handling system such that an electrical signal causes the detonation of the explosive charge 135. The detonation of explosive charge 135 can be controlled manually or by executing one or more instructions of a software program stored in a non-transitory memory of an information handling system, as familiar to one skilled in the pertinent art. While only one explosive charge 135 is illustrated, any number of explosive charges 135 in any number of configurations can be included.

Some embodiments of the system 200 can include one or more filler discs 240 disposed within a cavity of the simulated wellbore 215 between a simulated wellbore cap 245 of the simulated wellbore 215 and the tool 100. The one or more filler discs 240 may fit flush against the interior wall 250 of the simulated wellbore 215 or be of any other suitable dimensions according to a wellbore operation. The filler discs 240 can be composed of or include aluminum or any other suitable material. The filler discs 240 can reduce the volume or empty space of the cavity of the simulated wellbore 215 (e.g., the free interior volume inside the wellbore cavity, also referred to herein as the free wellbore volume, FWBV). The more volume that is consumed by the filler discs 240, the greater the magnitude of the pressure reduction experienced (DUB effect) post-detonation of the explosive charge 135. The filler disc 240 can be any size, dimension, or thickness suitable for a given operation. For instance, as the filler discs 240 occupy an increasing proportion of the space of the cavity of the simulated wellbore 215, and therefore reduce FWBV relative to the FGV, a larger magnitude of DUB effect can be expected. However, to increase the magnitude of a DOB effect both the FWBV and FGV would be reduced, e.g., by occupying greater amount of the volumes in the cavity of the simulated wellbore 215 and the total interior volume in the interior cavity 125 of the perforating tool 100 with the filler discs 240 and plates 130, respectively. That is, while a reduction in the FWBV can increase the magnitude of the DUB and DOB effects, it is the value of the FGV can be the primary driver for which direction of pressure effect result, e.g., a DUB or DOB effect.

The face plate 220 can be disposed within the simulated wellbore 215 between the perforating tool 100 and the formation sample 220 which includes, for example, a simulated casing or cement. The face plate 220 can be composed of or include steel and can be backed by a cement layer. In some embodiments, the tool 100 and the formation sample 220 can couple directly or indirectly to the face plate 220. In some embodiments, the tool 100 can be disposed or positioned within or adjacent to the face plate 220, for example, the tool 10 can be seated in one or more grooves (not shown) of the face plate 220.

Based on the present disclosure, one skilled in the art would understand how the FGV could be adjusted, by adding or subtracting plates, or using different sized plates, in the interior cavity to achieve a target DUB or DOB pressure response when testing the explosive charge to evaluate explosive charge performance.

For instance, prior to perforating the casing that lines a wellbore, the fluid in the wellbore may be isolated from the fluid (e.g., oil and gas) in the formation. Because of that isolation, the wellbore pressure can be set to some static pressure value relative to the pore pressure in the subterranean formation. A wellbore pressure set to be less than, greater than or the same as the pore pressure in the formation refer to a static underbalance, static overbalance and static on-balance pressure, respectively. After the explosive charge inside the perforating tool body is detonated, three different previously isolated volume zones can be nearly instantaneously hydraulically combined. The detonated explosive charge generates an explosive jet that punctures a hole in the perforation tool body and thereby hydraulically connects the FGV to the free interior volume inside the wellbore (e.g., the free wellbore volume, FWBV) and thereby hydraulically connects the FGV to the FWBV. The explosive jet also punctures through the casing and out into the subterranean formation and thereby hydraulically connects the FGV and the FWBV to the pore volume space of the formation. Thus during such a perforating operation the pressure of these three volumes zone are dynamically changing as they come to an equilibrium with each other. Whether a DUB or DOB pressure response is formed will depend upon at least the static pressure condition in the wellbore prior to the perforating operation and the FGV of the body.

As an example, consider a wellbore in an static overbalance pressure condition prior to perforating operation and the FGV is adjusted (by adjusting the number of plates 130 in the tool body 105 of the laboratory tool 100) such that when the FGV becomes hydraulically connected to the wellbore, the wellbore pressure drop to a value that is less than the pore pressure in the formation, resulting in a DUB pressure response. As another example, consider a wellbore in a static overbalance pressure condition prior to a perforating operation and the FGV is adjusted such that when the FGV becomes hydraulically connected to the wellbore, the wellbore pressure increases to a value that is greater than the pore pressure in the formation, resulting in a DOB pressure response. Based upon the present disclosure one skilled in the pertinent art would understand DUB and DOB pressure conditions could result when the wellbore is in a static underbalance, static on-balance or static overbalance pressure condition prior to perforating operation.

Aspects disclosed herein include a perforating tool. The tool can include a body, a first lid and a second lid. The first lid can be attachable to one end of the body and the second lid can be attachable to an opposite end of the body, to define an interior cavity of the body, the interior cavity having an air-tight seal with an exterior environment surrounding the body. The tool can include one or more plates disposable within the interior cavity such that the one or more plates are situated apart from an explosive charge when the explosive charge is disposed in the interior cavity. The one or more plates occupy part of a total interior volume of the interior cavity and thereby reduce a free interior volume inside the body.

In some such embodiments, the one or more plates in combination can occupy between 0 and 100 percent of the total interior volume of the interior cavity. In some such embodiments, individual ones of the plates can be sized such that any one of the plates occupy from greater than 0 to nearly 100 percent of the total interior volume. In some such embodiments, the plates can be composed of a non-deformable and impermeable material. In some such embodiments, a surface of one plate facing and nearest to the explosive charge can be shaped to form a depression that mirrors a shape of the explosive charge. In some such embodiments, at least two of the one or more plates can be shaped to stack together. In some such embodiments, the one or more plates are shaped to fit flush against an interior wall of the body. In some such embodiments, a surface of the second lid facing the interior cavity can include a port to secure a first end portion of a rod therein. A stem portion of the rods can be sized to pass through an opening in each of the one or more plates and a second end portion of the rod can include a stop structure sized to not pass through the opening in each of the one or more plates. In some such embodiments, each of the one or more plates can include an opening sized to allow a portion of a detonation cord there-though to connect to the explosive charge.

Aspects disclosed herein include another perforating tool. The tool can include a body, a first lid and a second lid. The first lid can be attachable to one end of the body and the second lid can be attachable to an opposite end of the body, to define an interior cavity of the body, the interior cavity having an air-tight seal with an exterior environment surrounding the body. The tool can include two or more plates disposable within the interior cavity such that the two or more plates are situated apart from an explosive charge when the explosive charge is disposed in the interior cavity. The two or more plates occupy part of a total interior volume of the interior cavity and thereby reduce a free interior volume inside the body.

In some such embodiments, a surface of one plate of the two or more plates that faces and is nearest to the explosive charge, touches the explosive charge. In some such embodiments, the surface of the one plate can be shaped to form a depression that mirrors a shape of the explosive charge. In some such embodiments, the two or more plates disposed within the interior cavity can be situated apart from the explosive charge. In some such embodiments, a surface of one plate of the two or more plates that faces and is nearest to the explosive charge can be shaped to form a depression that mirrors a shape of the explosive charge. In some such embodiments, the surface of the one plate of the two or more plates that faces and is nearest to the explosive charge can be a planar surface. In some such embodiments, the two or more plates in combination can occupy between 0 and 100 percent of the total interior volume of the interior cavity. In some such embodiments, individual ones of the plates can be sized such that any one of the plates occupy from greater than 0 to nearly 100 percent of the total interior volume. In some such embodiments, the plates can be composed of a non-deformable and impermeable material. In some such embodiments, a surface of one plate facing and nearest to the explosive charge can be shaped to form a depression that mirrors a shape of the explosive charge. In some such embodiments, at least two of the one or more plates can be shaped to stack together. In some such embodiments, a surface of the second lid facing the interior cavity can include a port to secure a first end portion of a rod therein. A stem portion of the rods can be sized to pass through an opening in each of the one or more plates and a second end portion of the rod can include a stop structure sized to not pass through the opening in each of the one or more plates. In some such embodiments, each of the two or more plates can include an opening sized to allow a portion of a detonation cord there-though to connect to the explosive charge.

Aspects disclosed herein include a perforating tool testing system. The system can include a simulated wellbore case; a simulated wellbore disposed within the simulated wellbore case; a face plate disposed at a first end of the simulated wellbore; a formation sample disposed within the simulated wellbore case, wherein the formation sample couples to the face plate; and a laboratory perforating tool disposed within the simulated wellbore between a second end and the first end of the simulated wellbore. The laboratory perforating tool can include any of the aspects of the laboratory perforating tools disclosed herein.

Further additions, deletions, substitutions and modifications may be made to the described embodiments.

What is claimed is:

1. A perforating tool, comprising:

a body, a first lid and a second lid, wherein the first lid is attachable to one end of the body and the second lid is attachable to an opposite end of the body, to define an interior cavity of the body, the interior cavity having an air-tight seal with an exterior environment surrounding the body, wherein the body is disposable within a simulated wellbore between a second end and a first end of the simulated wellbore;

an explosive charge disposable in the interior cavity of the body adjacent to the first lid, the explosive charge including a side wall disposable in the interior cavity such that the sidewall lines and contacts the explosive charge and contacts the first lid; and one or more plates disposable within the interior cavity such that the plate nearest to the explosive charge is situated apart from the explosive charge when the explosive charge is disposed in the interior cavity, wherein the one or more plates occupy part of a total interior volume of the interior cavity and thereby reduce a free interior volume inside the body.

2. The perforating tool of claim 1, wherein the one or more plates in combination occupy between 0 and 100 percent of the total interior volume of the interior cavity.

3. The perforating tool of claim 1, wherein individual ones of the plates are sized such that any one of the plates occupy from greater than 0 to nearly 100 percent of the total interior volume.

4. The perforating tool of claim 1, wherein the plates are composed of a non-deformable and impermeable material.

5. The perforating tool of claim 1, wherein a surface of one plate facing and nearest to the explosive charge is shaped to form a depression that mirrors a shape of the explosive charge.

6. The perforating tool of claim 1, wherein at least two of the one or more plates are shaped to stack together.

7. The perforating tool of claim 1, wherein the one or more plates are shaped to fit flush against an interior wall of the body.

8. The perforating tool of claim 1, wherein a surface of the second lid facing the interior cavity includes a port to secure a first end portion of one or more rods therein, wherein a stem portion of the rods are sized to pass through an opening in each of the one or more plates and a second end portion of the rods includes a stop structure sized to not pass through the opening in each of the one or more plates.

9. The perforating tool of claim 1, wherein each of the one or more plates include an opening sized to allow a portion of a detonation cord there-though to connect to the explosive charge.

10. A laboratory perforating tool for a wellbore, comprising:

a body, a first lid and a second lid, wherein the first lid is attachable to one end of the body and the second lid is attachable to an opposite end of the body, to define an interior cavity of the body, the interior cavity having an air-tight seal with an exterior environment surrounding the body, wherein the body is disposable within a simulated wellbore between a second end and a first end of the simulated wellbore;

an explosive charge disposable in the interior cavity of the body adjacent to the first lid, the explosive charge including;

a side wall disposable in the interior cavity such that the sidewall lines and contacts the explosive charge and contacts the first lid; and two or more plates disposable within the interior cavity such that the plate nearest to the explosive charge is situated apart from the explosive charge when the explosive charge is disposed in the interior cavity, wherein the two or more plates occupy part of a total interior volume of the interior cavity and thereby reduce a free interior volume inside the body.

11. The perforating tool of claim 10, wherein surfaces of the two or more plates facing each other or facing the explosive charge are planar.

12. The perforating tool of claim 10, wherein a surface of one plate of the two or more plates that faces and is nearest to the explosive charge is shaped to form a depression that mirrors a shape of the explosive charge.

13. The perforating tool of claim 10, wherein the surface of the one plate of the two or more plates that faces and is nearest to the explosive charge is a planar surface.

14. The perforating tool of claim 10, wherein the two or more plates in combination occupy between 0 and 100 percent of the total interior volume of the interior cavity.

15. The perforating tool of claim 10, wherein individual ones of the two or more plates are sized such that anyone of the plates occupy from at least 1 to nearly 100 percent of the total interior volume.

16. The perforating tool of claim 10, wherein the two or more plates are composed of a non-deformable and impermeable material.

17. A perforating tool testing system, comprising:

a simulated wellbore case;

a simulated wellbore disposed within the simulated wellbore case;

a face plate disposed at a first end of the simulated wellbore;

a formation sample disposed within the simulated wellbore case, wherein the formation sample couples to the face plate; and a laboratory perforating tool disposed within the simulated wellbore between a second end and the first end of the simulated wellbore, wherein the laboratory perforating tool includes:

a body, a first lid and a second lid, wherein the first lid is attachable to one end of the body and the second lid is attachable to an opposite end of the body, to define an interior cavity of the body, the interior cavity having an air-tight seal with an exterior environment surrounding the body, and one or more plates disposable within the interior cavity such that the one or more plates are situated apart from an explosive charge when the explosive charge is disposed in the interior cavity, wherein the one or more plates occupy part of a total interior volume of the interior cavity and thereby reduces a free interior volume inside the body, wherein:

the explosive charge is disposed such that detonation of the explosive charge creates a perforation in the formation sample, and the one or more plates affect a dynamic underbalance or dynamic overbalance of the perforating tool testing system.

* * * * *